US005666781A

United States Patent [19]

Egawa et al.

[11] Patent Number: 5,666,781

[45] Date of Patent: Sep. 16, 1997

[54] METAL FASTENERS FOR WOOD CONSTRUCTION USE AND A METHOD OF CONSTRUCTING A HOUSE

[75] Inventors: Goro Egawa, Hyogo; Yuzo Saito, Osaka, both of Japan

[73] Assignee: Daiichi Shoten Co., Ltd., Osaka, Japan

[21] Appl. No.: 591,974

[22] Filed: Jan. 29, 1996

[51] Int. Cl.[6] ..... E04C 3/18; E04C 3/29

[52] U.S. Cl. ..... 52/747.1; 52/698; 52/712; 411/902

[58] Field of Search ..... 52/517, 101, 232, 52/698, 712, 747.1; 411/902

[56] References Cited

U.S. PATENT DOCUMENTS 2,718,647 9/1955 Raible ..... 411/902 X 3,292,481 12/1966 Couch ..... 411/921 X

FOREIGN PATENT DOCUMENTS 61-29848 2/1983 Japan .

*Primary Examiner*—Christopher T. Kent

*Attorney, Agent, or Firm*—Larson & Taylor

[57] ABSTRACT

A metal fastener for joining a wooden architectural member to a wooden or other architectural member for wood construction use includes a metal fastener base and a copper or copper-containing cladding enshrouding the metal base. A method of constructing a wooden building with the aid of the above metal fastener is also provided. The metal fastener provided with the copper or copper-containing cladding is effective in preventing rotting of the wood adjoining the metal fastener.

6 Claims, 3 Drawing Sheets

METAL FASTENERS FOR WOOD CONSTRUCTION USE AND A METHOD OF CONSTRUCTING A HOUSE

FIELD OF THE INVENTION

The present invention relates to metal fasteners for wood construction which are used for joining wooden architectural members to wood or other architectural members and to a method of assembling architectural members into a building with the aid of said metal fasteners.

BACKGROUND OF THE INVENTION

In wood construction, architectural members such as columns, studs, girders, and beams, all made of wood, are used. In assembling a column with a girder, for instance, the so-called mortise-and-tenon joint in which a tenon of one member is snugly fitted into a mortise formed in the other member is generally employed. There also are cases in which metal fasteners are used to reinforce the joint between wooden architectural members.

However, in the above construction system, the mortises and tenons must be intricate in structure and require high dimensional precision so that the construction time is prolonged.

Therefore, recent years have witnessed an increasing popularity of prefabricated homes even in the field of wood construction where factory-manufactured wooden architectural members are assembled at sites of construction. For reducing the construction time and cost in this field, convenient, high-strength joint and metal fasteners are being used in lieu of mortise-and-tenon joints which require delicate workmanship and metal fasteners of various configurations have so far been proposed.

However, since wooden architectural members are hygroscopic, the problem of rot due to dew condensation tends to take place. Moreover, as the result of the widespread use of insulation materials for insuring effective air conditioning and the hermetic sealing of the rooms in recent years, dew condensation is more liable to occur than before between the exterior and interior walls or sidings. Such dew formation not only causes rusting of metal joints and reinforcing metal members but the moisture trapped between the metal member and the adjoining wood encourages growth of various wood-decaying microorganisms so that the wood easily begins to rot in the vicinity of the joints.

To overcome the above disadvantages, metal members subjected to rust-proofing treatment such as molten zinc plating have been utilized in recent years but such fasteners are not fully effective in preventing wood rot.

OBJECT AND SUMMARY OF THE INVENTION

The object of the present invention is to prevent rusting of metal fasteners due to moisture derived from wooden structural members and rotting of the wood contacting the metal.

The inventors doing much research for overcoming the above disadvantages have developed the present invention.

The present invention provides a metal fastener for joining a wooden architectural member to a wooden or other architectural member which comprises a fastener metal base and a copper or copper-containing cladding enshrouding said metal base.

Particularly the invention provides a metal fastener for wood construction which is provided with a copper plating layer.

The present invention further provides a method of assembling wooden architectural members into a building with the aid of such metal fasteners.

The metal fastener for wood construction according to the present invention is now described in detail.

DETAILED DESCRIPTION OF THE INVENTION

The metal fastener according to this invention comprises a fastener metal base which may be a conventional metal fastener for wood construction and a copper cladding or a copper-containing cladding enshrouding the metal base. The fastener metal base that can be used includes fastener metal bases made of various metallic materials such as steel, brass, aluminum and so on. As to configurations of the fastener metal base, hurricane straps, joist hanger metals, beam supports, stud-beam joints, battledore bolts, etc. can be mentioned by way of example.

Disposition of a copper or copper-containing layer on the surface of such a fastener metal base can be effected by the per se known cladding techniques such as plating e.g. molten metal plating, electroless plating, etc. or coating with a copper-containing coating material. However, a plating process is preferred because it provides for complete sealing of the base metal surface against the atmosphere as well as high film strength.

The thickness of the cladding layer on the fastener metal base may range from 10 to 80 m and is preferably 20–60 μm. If the thickness is less than 10 μm, injury on handling may result in exposure of the metal base and encourage corrosion of the metal. Conversely, if the thickness exceeds 80 μm, an increased production cost will be inevitable.

The method of joining wooden architectural members with the aid of the metal fastener according to the invention in several modes is now described in detail.

EXAMPLE 1

Figure 1:
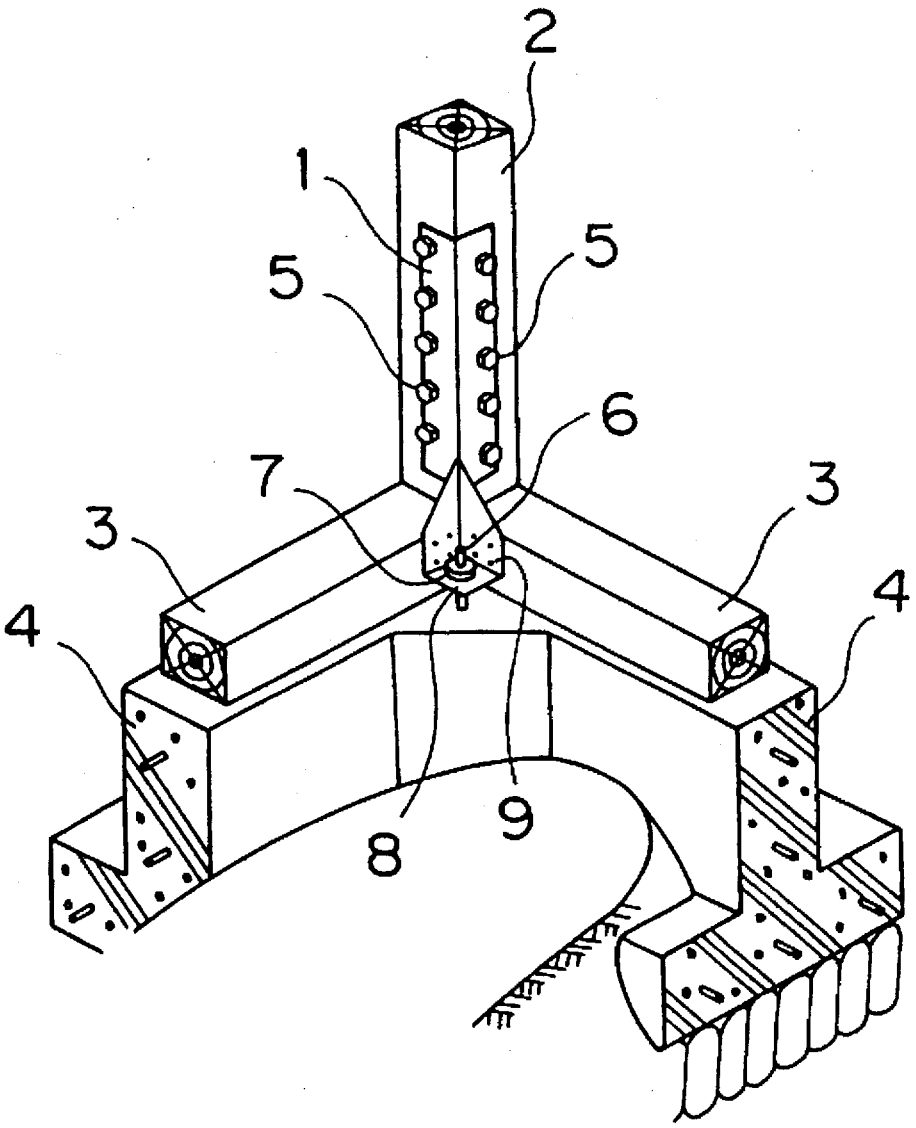
FIG. 1 is a perspective view showing an embodiment of the invention wherein a sill and a corner column are secured to a foundation using a single framework metal fastener of the invention, FIGS. 2A and 2B respectively show a cross-section view and a plan view of another embodiment of the invention wherein a battledore bolt according to the invention is employed.

As the metal base, a framework steel fastener 1 as shown in FIG. 1 was used. Deposited on this metal base was a 30 μm-thick copper plating layer by the conventional plating method.

Shown in FIG. 1 is an embodiment in which a sill and a column are secured to a foundation with the aid of the above copper-plated framework metal fastener. Thus, a column 2 is rigidly secured to a sill 3 and a foundation 4 by means of the framework metal fastener 1. More particularly, the metal fastener 1 is fixed to the column 2 by setbolts 5, to the sill 3 by nails 9, and to the foundation 4 by means of a holder bottom plate 8 of fastener 1 having an anchor bolt 6 and a nut 7.

The framework assembly thus obtained is satisfactory in joint strength and is well protected against rusting of the joint metal and decaying of the wood contacting the metal.

EXAMPLE 2

Figure 2A:
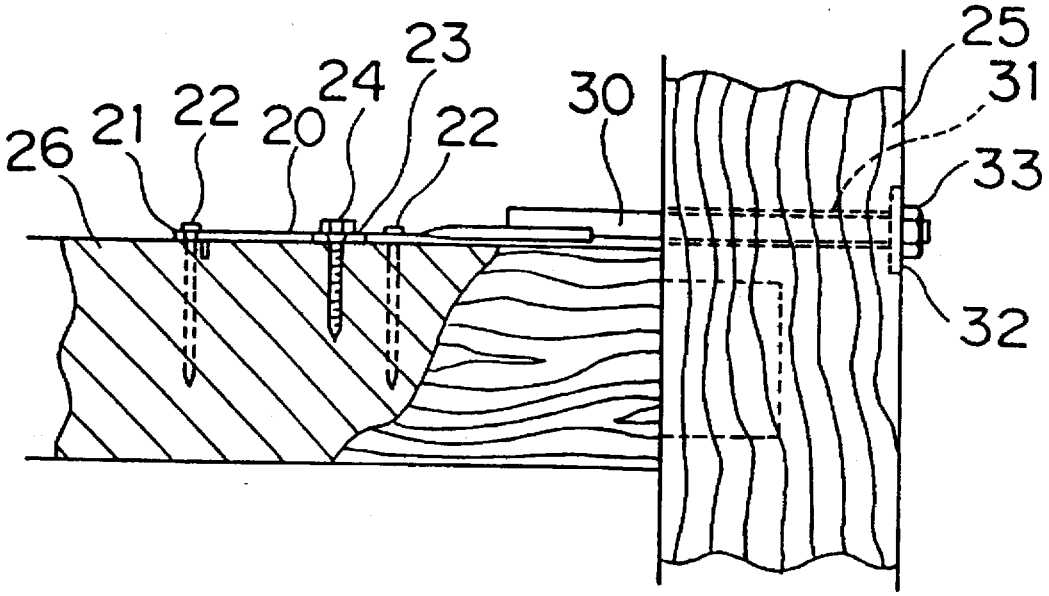
Figure 2B:
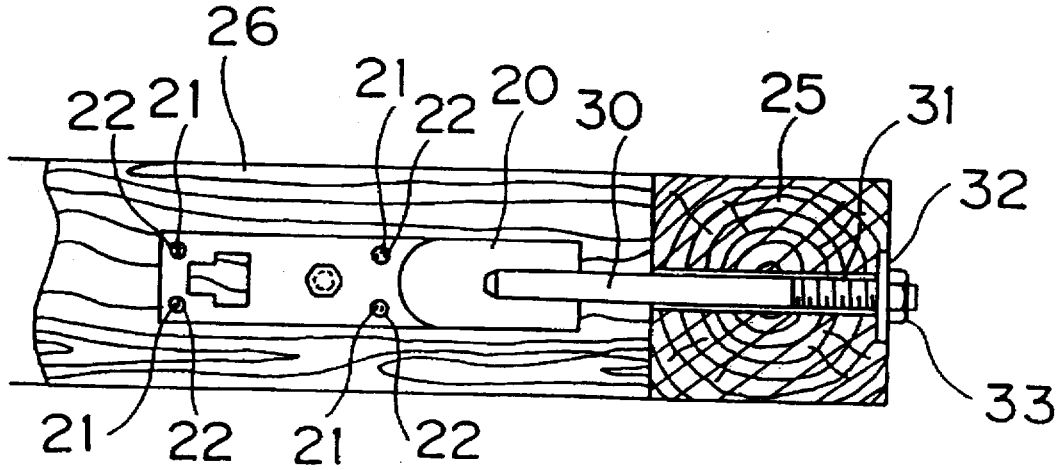

The procedure of Example 1 is repeated to deposit a cladding layer except that a steel battledore bolt is used as the fastener metal base. The dry thickness of the cladding is 30 μm. FIG. 2 shows an embodiment of the invention in which structural members are joined with the aid of this battledore bolt.

First, nails 22 are set into four nail holes 21 in the battledore bolt 20 and with a coach screw 24 threaded into a coach screw hole 23, the battledore bolt 20 is rigidly secured to one wooden member 26. Then, a bolt portion 30 of said battledore bolt 20 is passed through an open hole 31 in another wooden member 25 and secured with a nut 33 through a washer 32, whereby the two wooden members 25 and 26 are joined to each other.

The structural assembly thus obtained is satisfactory in joint strength and is well protected against rusting of the metal joint and rotting of the wood due to moisture.

EXAMPLE 3

Figure 3A:
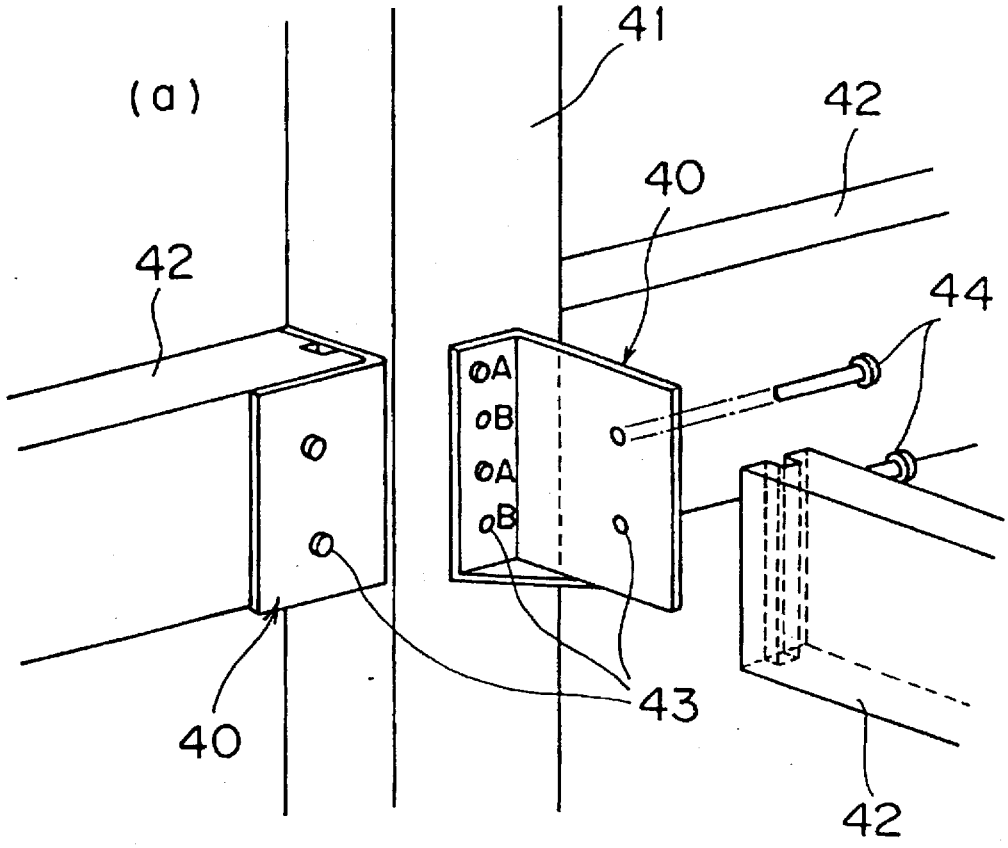
FIGS. 3A and 3B respectively show a perspective view and a plan view of an embodiment wherein another framework metal fastener according to the invention is employed.
Figure 3B:
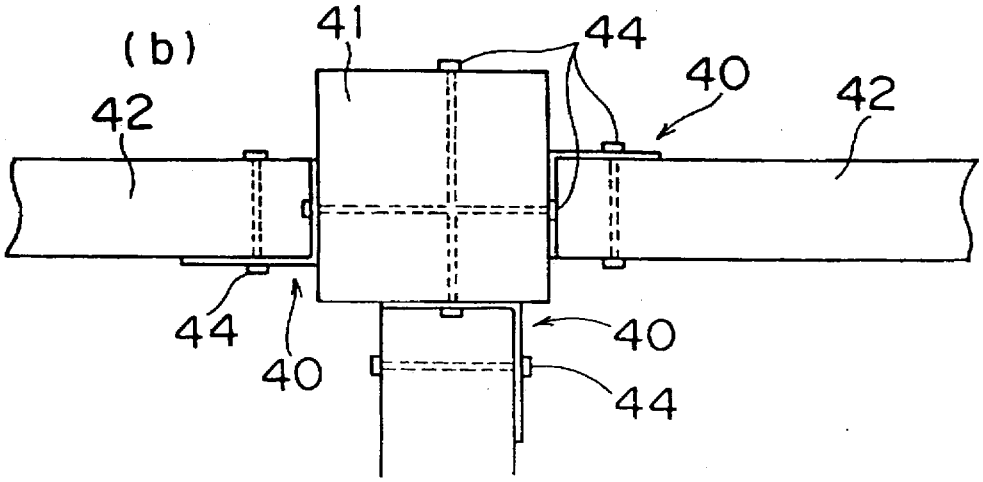

As the fastener metal base, the steel framework butt-end joint illustrated in FIG. 3 was used. This metal base was coated with a coating composition containing 15 parts by weight of copper dust per 100 parts by weight of the coating to provide a film having a dry thickness of 50 μm.

FIG. 3 shows a perspective view and a plan view, both showing an embodiment in which the above butt-joint framework of the invention is employed. In FIG. 3, the butt-end joint 40 having holes 43 is rigidly secured to a structural member of laminated wood 41 with the aid of setbolts 44. Then, a wooden member 42 is rigidly secured to said structural member 41 with a setbolt 44. In this manner, the wooden member 42 is secured to the structural member 41 at right angles.

The framework assembly thus obtained is very satisfactory in joint strength and is well protected against rusting of the metal joint and rotting of the wood due to moisture.

Since the surface of the metal fastener of the invention is covered with a copper cladding or a copper-containing cladding, the use thereof in the joining of a wooden member to a wooden or other member is effective in preventing rotting of the wood contacting the metal base.

What is claimed is:

1. A method of constructing a wooden building which includes wooden architectural members comprising the steps of:

providing a metallic fastener having at least one attachment surface, the metallic fastener being completely covered with a copper containing layer so as to form a copper covered metallic fastener; and joining of two of the wooden members with the copper covered metallic fastener, said joining step including the steps of placing the attachment surface of the copper covered metallic fastener against a surface of a first wooden member, fastening the attachment surface of the copper covered metallic fastener to the surface of the first wooden member using a first fastening element, and fastening a portion of the copper covered metallic fastener adjacent to the attachment surface to a second wooden member using a second fastening element so that the first and second wooden members are thus joined to one another through the copper covered metallic fastener.

2. A method of constructing a wooden building as claimed in claim 1 wherein the copper containing layer is a copper containing plating layer.

3. A method of constructing a wooden building as claimed in claim 1:

wherein said providing step provides the attachment surface and the adjacent portion as abutting flat surfaces; and wherein said joining step includes the steps of abutting respective flat surfaces of the first and second of the wooden members against one another, and securely attaching each respective abutting flat surface of the copper covered metallic fastener to a respective abutting flat surface of the two wooden members to secure the two wooden members immovably to each other.

4. A method of constructing a wooden building as claimed in claim 1 wherein said fastening of the attachment surface step includes fastening with a plurality of the first fastening elements.

5. A method of constructing a wooden building as claimed in claim 4 wherein said fastening of the adjacent portion step includes fastening with a single threaded member as the second fastening element.

6. A method of constructing a wooden building as claimed in claim 4 wherein said fastening of the adjacent portion step includes fastening of a second attachment surface of the copper covered metallic fastener to a second surface of the second wooden member with a plurality of the second fastening elements.

* * * * *